US008661960B2

(12) United States Patent
Ohlson

(10) Patent No.: US 8,661,960 B2
(45) Date of Patent: Mar. 4, 2014

(54) CLOSED VESSEL ARRANGEMENT FOR SAFE DESTRUCTION OF ROCKET MOTORS

(75) Inventor: Johnny Ohlson, Kil (SE)

(73) Assignee: Dynasafe International AB, Stockholm (SE)

( * ) Notice: Subject to any disclaimer, the term of this patent is extended or adjusted under 35 U.S.C. 154(b) by 73 days.

(21) Appl. No.: 13/391,246

(22) PCT Filed: Aug. 21, 2009

(86) PCT No.: PCT/SE2009/000388

§ 371 (c)(1),
(2), (4) Date: Feb. 17, 2012

(87) PCT Pub. No.: WO2011/021969

PCT Pub. Date: Feb. 24, 2011

(65) Prior Publication Data

US 2012/0144982 A1 Jun. 14, 2012

(51) Int. Cl.
*F42B 33/00* (2006.01)

(52) U.S. Cl.
USPC ..... 86/50; 86/49

(58) Field of Classification Search
USPC ..... 86/49, 50
See application file for complete search history.

(56) References Cited

U.S. PATENT DOCUMENTS

| | | | | |
|---|---|---|---|---|
| 3,239,092 | A * | 3/1966 | Levenetz | 220/590 |
| 4,100,783 | A | 7/1978 | Gambarov et al. | |
| 4,621,559 | A * | 11/1986 | Ohlson | 86/50 |
| 5,458,071 | A | 10/1995 | Tadmor et al. | |
| 6,359,188 | B1 | 3/2002 | Parkes | |
| 2003/0050524 | A1 * | 3/2003 | Northcutt | 588/202 |
| 2003/0131722 | A1 * | 7/2003 | Donovan | 86/50 |
| 2004/0134335 | A1 * | 7/2004 | Holland et al. | 86/50 |
| 2007/0161844 | A1 | 7/2007 | Gaudre et al. | |
| 2008/0282545 | A1 | 11/2008 | Weerth | |
| 2009/0165636 | A1 * | 7/2009 | Asahina et al. | 86/50 |

FOREIGN PATENT DOCUMENTS

| | | | |
|---|---|---|---|
| EP | 0461336 | A2 | 12/1991 |
| JP | 07-208900 | A | 8/1995 |
| JP | 2007303738 | A | 11/2007 |
| RU | 2345283 | C1 | 1/2009 |

* cited by examiner

*Primary Examiner* — Samir Abdosh

(74) *Attorney, Agent, or Firm* — Novak Druce Connolly Bove + Quigg LLP

(57) ABSTRACT

The present invention relates to a closed vessel arrangement (1) comprising a closed vessel (2) for safe destruction of a rocket motor (3) containing a solid propellant (4) by burning the rocket motor (3) inside the closed vessel (2), which closed vessel (2), is adjustable in size to a rocket motor (3). The invention is characterized in that the closed vessel (2) comprises two communicating chambers (7, 8) coaxially arranged to each other, one outer chamber (8) and one inner chamber (7), which chambers (7, 8) are divided into a plurality of connectable sections (13), which sections (13) are connectable in various numbers for adjusting the size of the vessel (2) to rocket motors (3) of various sizes.

8 Claims, 5 Drawing Sheets

CLOSED VESSEL ARRANGEMENT FOR SAFE DESTRUCTION OF ROCKET MOTORS

CROSS REFERENCE TO RELATED APPLICATIONS

This application is a 35 U.S.C. §371 National Stage Application of International Application No. PCT/SE2009/000388, filed Aug. 21, 2009, the entire contents of which are hereby incorporated by reference.

The present invention relates to a closed vessel arrangement comprising a closed vessel for safe destruction of propellant filled objects by burning the propellant filled object in said closed vessel. The closed vessel arrangement is particularly intended for the destruction of propellant filled rocket motors.

The invention is especially suitable for use in the destruction of rocket motors of various sizes and of rocket motors containing propellants, which generate hazardous and environmentally harmful combustion products.

PROBLEM DEFINITION AND BACKGROUND OF THE INVENTION

An increased number of potentially hazardous and environmentally harmful rockets in military storages have become an environmental problem. Due to new legislations, which prohibits open air destruction, arrangements for controlled burning of rocket motors in closed vessels, where combustion products can be collected for safe disposal, have been developed, One such closed vessel arrangement is disclosed in U.S. Pat. No. 5,458,071. The closed vessel arrangement in U.S. Pat. No. 5,458,071 comprises a pressure and heat resistant destruction chamber and a neck portion fitted with a lid capable of hermetic sealing, gripper means for tightly mounting a rocket engine having a solid fuel charge and a nozzle facing the gas chamber. The vessel is immersed in a cooling tank filled with water, for cooling the vessel.

A disadvantage of the closed vessel arrangement in U.S. Pat. No. 5,458,071 is the large sized destruction chamber 2, especially when small rocket motors are to be destructed. Another disadvantage is occurrence of solid deposits on the inner wall of the chamber. Solid residues, generated by the propellant burning, will deposit on the inner wall and disturb connections to the vessel, such as inlet and outlet pipe connections. Thus, solid deposits on the inner wall will require frequent and extensive cleaning of the chamber.

A further disadvantage is the closed vessel design, which does not admit easy cleaning and repairing of the vessel.

OBJECT AND CHARACTERISTICS OF THE INVENTION

A main object of the invention is to provide a closed vessel design, which easily can be adjusted in size to fit various rocket motor sizes to be destructed.

A further object is to provide a closed vessel, arranged such that solid residues are prevented from being deposit on the inner wall of the vessel.

Still a further object is to provide a closed vessel, which is easy to assemble and disassemble for easy cleaning and repairing.

Said objects and other objects not enumerated here are satisfactorily achieved within the scope of the present independent patent claims. Embodiments of the invention are specified in the dependent patent claims.

The invention has therefore provided a closed vessel arrangement comprising a closed vessel for safe destruction of rocket motors containing solid propellant by burning the rocket motor inside the closed vessel arrangement, which closed vessel, is adjustable in size to rocket motors of various sizes.

The essential characteristic of the closed vessel arrangement according to the invention is that the closed vessel comprises two chambers, one outer chamber and one inner chamber arranged coaxially to each other, which outer and inner chambers are divided into a plurality of connectable sections, which are connectable in various numbers for adjusting the size of the vessel to rocket motors of various sizes.

According to further aspects of the closed vessel arrangement according to the invention:

- the vessel is partly filled with water forming a water bath, for cooling the vessel and for absorbing combustion gases and solid residues,
- the inner chamber comprises a plurality of gas openings for directing flow of combustion gases and solid residues from the inner chamber to the outer chamber via the water bath,
- the vessel comprises at least one water inlet for supplying fresh water to the vessel, at least one water outlet for emptying spent water and solid residues from the vessel, at least one gas outlet for emptying combustion gases from the vessel and at least one gas inlet for supplying reaction gases and flushing air to the vessel,
- the outer chamber comprises two releasable gables, one front gable and one rear gable, which releasable gables are coupled to the outer chamber by bayonet couplings,
- the front gable and the rear gable are arranged slidably on rails for easy handling,
- the chamber sections are connected to each other by bolt connections,
- the rocket motor fixture is arranged slidably, in a through hole in the front gable, between two positions, one inlet firing position, inside the vessel, and one out let loading position, outside the vessel.

ADVANTAGES AND EFFECTS OF THE INVENTION

The invention proposed above affords several advantages. An closed vessel arrangement comprising two coaxial arranged chambers divided in several chamber sections, which chamber sections are releasable and connectable in various number makes the vessel easy adjustable in size to different rocket motors. Said arrangement is easy to assemble and dissemble for cleaning and repairing purposes. Using an inner chamber prevents solid combustion products from being deposit on the inner wall, thus preventing solids from plugging in- and outlets to the vessel. The risk for leakage of harmful gases and solids are eliminated or reduced. Using a slideable rocket fixture improves handling of rocket motors in the system. The improved flexibility of the system makes the system safe and easy and thus cost efficient.

Further advantages and effects will emerge from a study and consideration of the following detailed description of the invention, including a number of advantageous embodiments thereof, and the figures of the drawings attached.

The invention has been more closely specified in the following patent claims and will now merely be described in more detail with reference to the attached drawings, FIG. 1 to FIG. 10, which schematically shows the main parts of a destruction facility of the type characteristic of the invention.

DESCRIPTION OF THE DRAWINGS

The invention will be described in more detail below with reference to the drawings attached, in which.

DETAILED DESCRIPTION OF EMBODIMENTS

Figure 1:
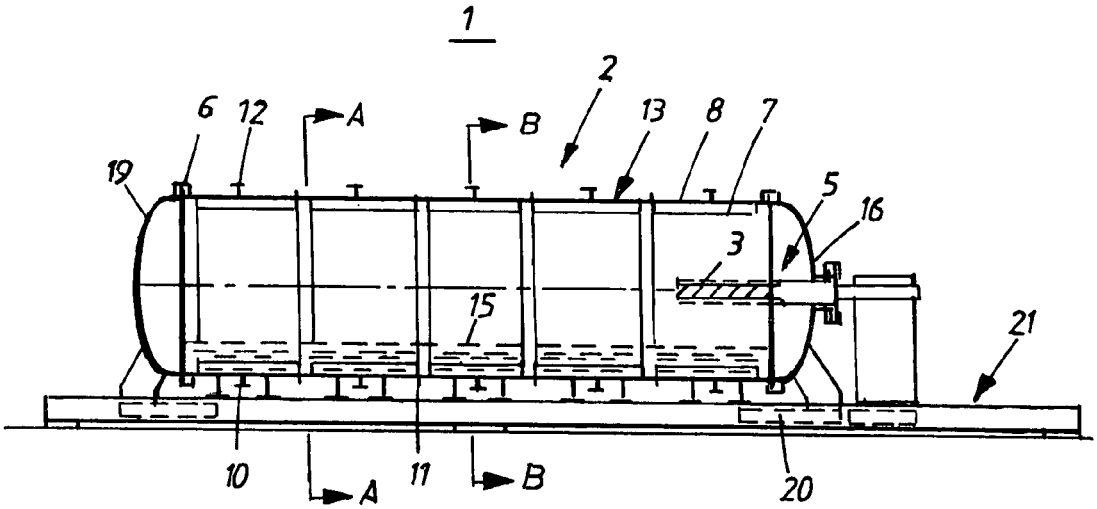
FIG. 1 schematically shows a longitudinal section of a closed vessel arrangement according to the invention, in which the rocket motor fixture is arranged in the front part of the closed vessel, FIG. 2 schematically shows a longitudinal section of a closed vessel arrangement in FIG. 1 from above.
Figure 2:
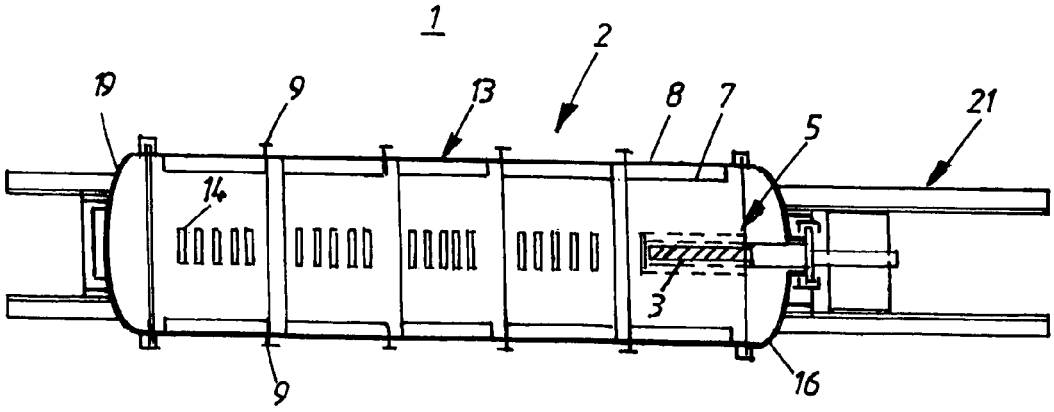
Figure 3:
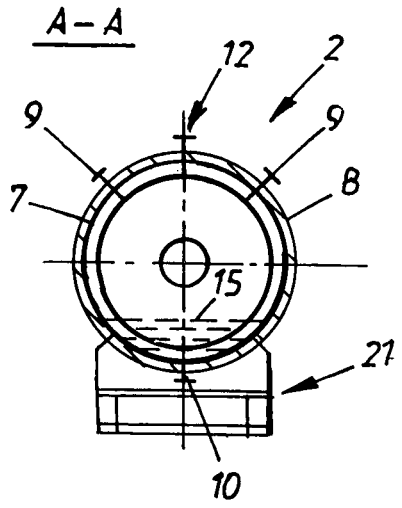
FIG. 3 shows a cross section A-A of the closed vessel arrangement in FIG. 1.

FIG. 1-4 shows a preferred embodiment of a rocket motor destruction system (RMDS) 1 according to the invention. The rocket motor destruction system (RMDS), comprises a closed vessel 2, which is a gastight explosion resistant vessel 2 for destruction of a rocket motor 3 containing a propellant charge 4 by burning the rocket motor charge 3 inside the closed vessel 2, a rocket motor fixture 5 in which the rocket motor 3 is mechanically fixed in a position for later firing, a water recirculation system for providing the closed vessel 2 with water 15 for cooling and absorbing combustion products such as solid residues generated by the propellant burning, and a combustion gas treatment system for treatment and for safe deposit of propellant gases, not shown in the figures.

Figure 4:
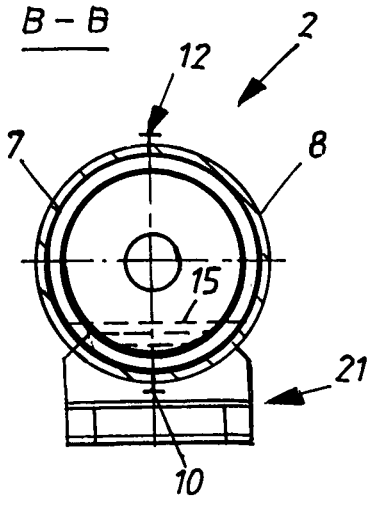
FIG. 4 shows a cross section B-B of the closed vessel arrangement in FIG. 1.
Figure 5:
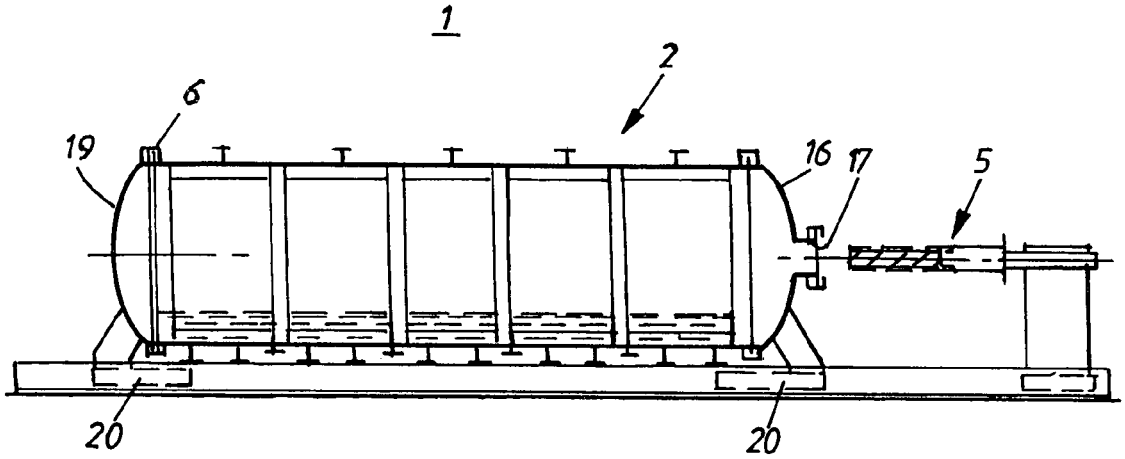
FIG. 5 shows the closed vessel arrangement in FIG. 1, where the rocket motor fixture is in the loading position, outside the vessel.
Figure 6:
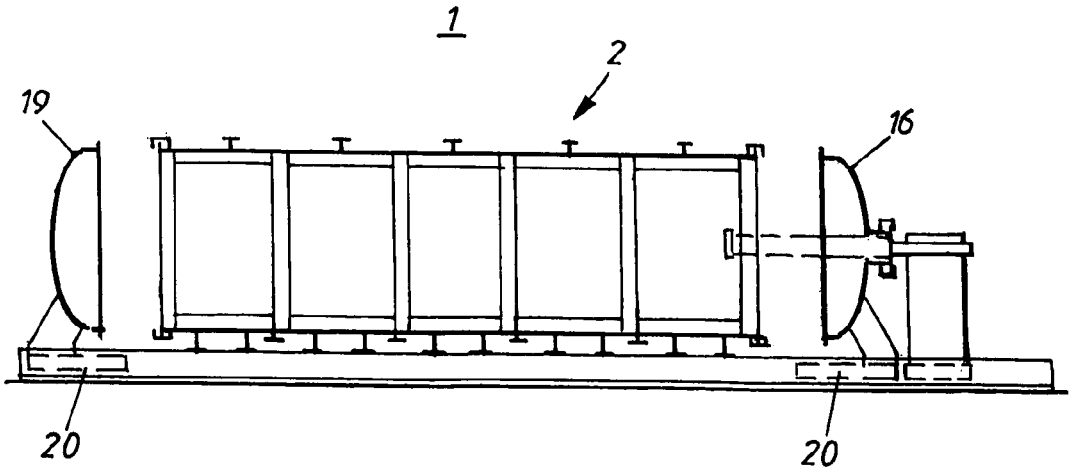
FIG. 6 shows the closed vessel arrangement in FIG. 1, where the front gables are released from the vessel.
Figure 7:
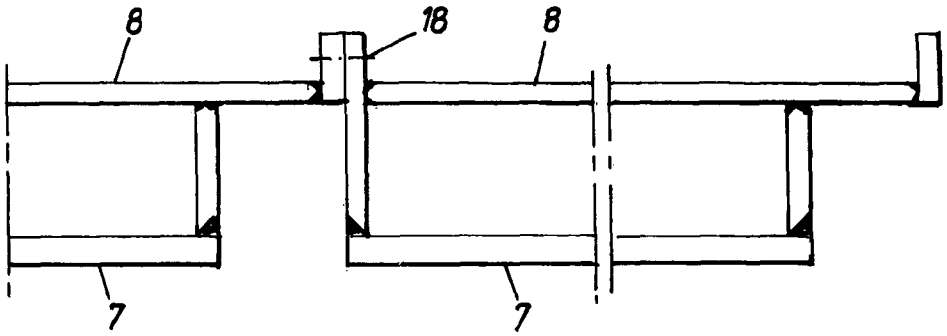
FIG. 7 shows a partial enlargement of the connection between two chamber section in FIG. 1, where the sections are connected via the outer chamber.
Figure 8:
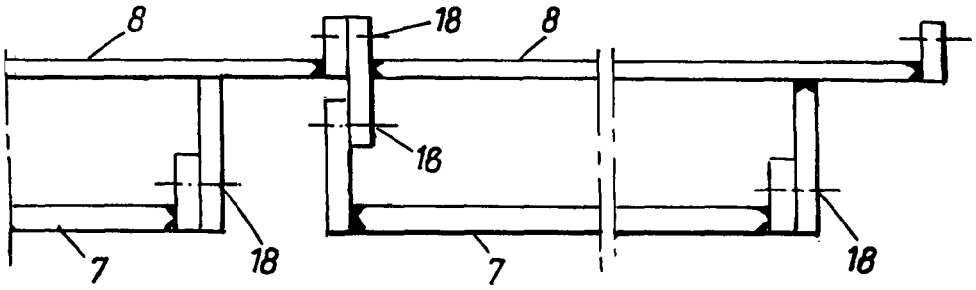
FIG. 8 shows a partial enlargement of the connection between two chamber sections in FIG. 1, where the sections are connected via the outer- and inner chambers.
Figure 9:
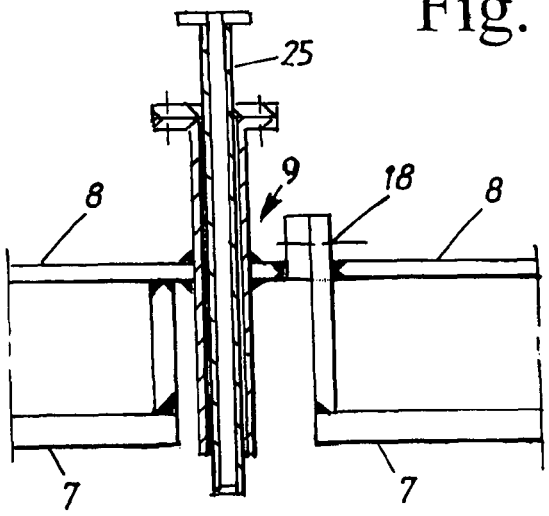
FIG. 9 shows a partial enlargement of a water inlet flange in FIG. 1, and a spray nozzle arranged in the water inlet.

The closed vessel 2 further comprises an inner chamber 7 for coping with high peak pressures and main heat generated by the rocket motor 3 firing, an outer chamber 8 for coping with static and dynamic pressure, structural steel works and platforms 21 for supporting the closed vessel 2, at least one pressure resistant water inlet 9, preferably, comprising spraying nozzles 25, FIG. 9, for feeding fresh water 15 to the vessel 2, one pressure resistant water outlet 10, FIG. 4, for emptying the vessel 2 from spent water 15 and solid residues, a sludge container for storing of waste, not shown. The water inlet 9 and the water outlet are, preferably, equipped with control valves. The vessel 2 also comprises at least one gas inlet 12 comprising pressure resistant control valve for feeding gases and flushing air to the closed vessel 2 and at least on gas outlet 11 comprising a pressure resistant control valve to regulate pressurized gas flows out from the vessel 2 to a gas treatment system outside the vessel 2, which is not shown in the figures, The inner chamber 7 and the outer chamber 8 are, cylindrically shaped and arranged coaxially to each other. The chambers 7, 8 are divided into a plurality of connectable chamber sections 13, which chamber sections 13 are connectable in various numbers to each other, such that the vessel 2 is adjustable in size to different rocket motors 3. The chamber sections 13 are, preferably, connectable by bolt connections 18, FIG. 7 and FIG. 8, but other connection means may also be used. FIG. 7 shows a first variant of the preferred embodiment, were the sections 13 are bolt connected 18 via the outer chamber 8. FIG. 8 shows a second variant where the sections 13 are bolt connected 18 both via the outer chamber 8 and the inner chamber 7, admitting both the outer chamber 8 and the inner chamber 7 to be dissembled. The inner chamber 7 is, preferably, made of high grade steel to withstand high dynamic and static pressure during firing of the rocket motor 3. The inner chamber 7 is a consumable part, easy exchangeable, if for example, the inner chamber 7 has been damaged by a rocket motor 3 explosion. The inner chamber 7 is open to the outer chamber 7 via a plurality of gas openings 14 arranged in the lower part of the inner chamber 7. Gas and solids from the propellant 3 burning flows, guided via gas openings 14, through a water bath 15 in the lower part of the vessel 2, to the outer chamber 8. Gas and solids are trapped, and partly absorbed, in the water bath 15. By adding chemical additives to the water 6, the absorption of gas and solids in the water bath 15 may be improved.

The outer chamber 8, which is designed to resist high static and dynamic pressure, comprises two releasable gables 16, 19, for easy opening of the vessel 2, one front gable 16 and one rear gable 19.

The two gables 16, 19 are preferably, coupled to the outer chamber 8 by bayonet couplings 6. The front gable 16 has a through hole 17, in which the rocket motor fixture 5 is arranged slidably between two operating positions, one inlet firing position, inside the vessel 2 and one outlet loading position, outside the vessel 1. The rear gable 19 is arranged for dismounting and releasing the inner chamber 7 from the vessel 2.

Both the front gable 16 and rear gable 19 are arranged slidably on rails 20 for easy handling. The rails 20 may be arranged on the outside or on the inside of the vessel 2.

The water recirculation system consists of; a pump for pumping water containing sludge from the closed vessel 2 via the pressure resistant valve 11 to two storage containers equipped with: a stirring device, a temperature measuring device, a pH measuring device, a conductivity measuring device, a sodium hydroxide dosing device, a pump for a internal water cleaning system, a storage tank before re-feeding the water to the firing chamber. The internal water cleaning system consist of, mechanical filter, a cooler with bypass, a feeding water tank with additive dosing, temperature measuring, pH measuring and conductivity measuring devices.

The gas treatment system, mainly consist of a thermal afterburner having an operating range between 800 C-1200° C. with a retention time of about 2 seconds, a spray-dryer, a gas cooler having an operating range between 1200° C.-200° C., a mechanical filter with additive dosing, a quenching cooler having an operating range from 80° C. to 200° C., an acid scrubber, a ventilator and a sodium-hydroxide dosing station.

Figure 10:
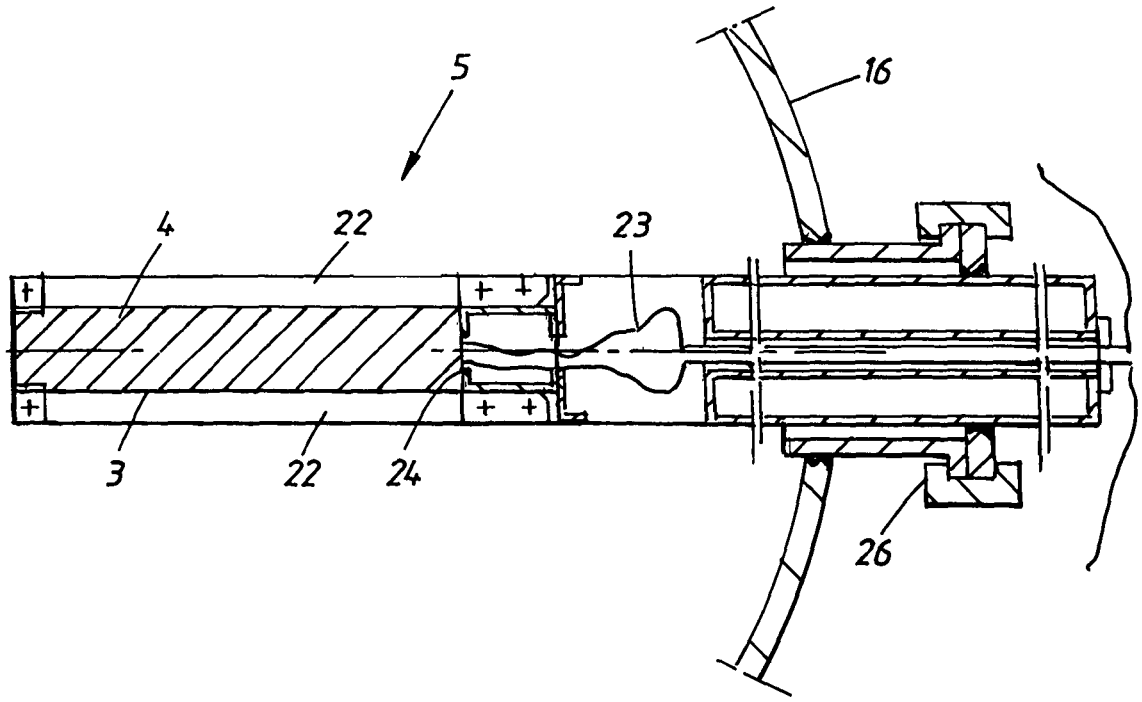
FIG. 10 shows a partial enlargement of the rocket motor fixture in FIG. 1.

As shown in FIG. 10 a rocket motor 3 is mounted in the rocket motor fixture 5, preferably by using adjustable clamps 22; which clamps 22 are fixed with bolts adapted to be breakable at a predefined pressure to release the fixture 5 in case of an explosion. Loading of a rocket motor 3 in the rocket motor fixture 5 are carried out at floor level with the rocket motor fixture 5 in a horizontal position. The ignition function of the rocket motor 3 is manually connected with a firing line 23 outside the rocket motor fixture 5 to a connecting point 24 inside the rocket motor fixture 5. The connecting point 24 can be connected to the firing line 23 from the outside. The firing line 23 is only connected, when the rocket motor fixture 5 is locked in the firing position inside the closed vessel 2.

As the rocket motor fixture 5 can be handled as a separate unit, such that loadings and firings can be performed in different rooms, several rocket motor fixtures 5 can be handled simultaneously, which saves time.

A rocket motor fixture 5 loaded with a rocket motor 3 arrives to the room where the closed vessel arrangement 2 is located. The rocket motor fixture 5 is inserted in the trough hole 17 in the front gable 16 of the vessel 2. The rocket motor fixture 5 is moved to the inlet firing position, where it is locked in position. The rocket motor fixture 5 is preferably arranged slidably on rails 20 and coupled to the front gable 16 by a bayonet coupling 26.

An operator is connecting the firing line 23 to an outside connecting point of the rocket motor fixture 5. From a control panel, located in a safe distance from the closed vessel 2, the rocket motor 3 is ignited. Depending on type of rocket motor 3, the burning time may vary within a range of a few seconds. In this time-frame the rocket propellant 4 is burned and combustion products are released and safely collected by the RMDS system.

Gas generated by the propellant burning is guided via the gas openings 14 through the water bath 15 where parts of the combustion products are absorbed, before the gas reach the gas treatment system outside the vessel 2. It is of special importance to trap fine aluminium oxide particles generated by propellant containing aluminized fuels, chlorine gas generated by propellant containing ammoniumperchlorate oxidizers. It has been shown that a significant amount of chlorine gas can be absorbed in the water bath 15 before the gas reach the gas treatment system.

After a predefined retention time in the vessel 2, the gas-outlet 11 to the gas treatment system is slowly opened. The gas treatment system is necessary to assure that: a) unburned gases are fully oxidized, b) hazardous materials such as aluminium oxides and chlorine has been removed c) the nitrogen oxide level has been reduced to an acceptable level d) salt has been removed from the water 15 by evaporation.

Basis of the gas cleaning system is the European regulation EU 2000/76.

As soon as the all gas has been released from the vessel 2 and the gas pressure has decreased to atmospheric level, the vessel 2 is flushed with fresh air. All valves 9,10,11,12 are closed and the system is ready for next firing. Normally, water 15 remains in the vessel 1 for several firings.

The frequency, of which the water 15 is exchanged in the vessel 2, depends on the rocket motor 3 type and the amount of combustion products generated in the system. Spent water 15 is pumped to a storage tank, located outside the vessel 2, where remaining solids are removed from the water 15, by filtering.

The water 15 is evaporated and treated for neutralization. When fresh water 15 is feed to the vessel 2, there is a possibility to add chemical additives to the system.

Normally, the rocket motor fixture 5 and the fired rocket motor 3 is dismounted and removed from the vessel 2 without any problem. In rare cases, when a rocket motor 3 is destroyed e.g. due to an explosion, remaining parts in the rocket motor fixture 3 can easily be released as the rocket motor 3 is attached by the breakable clamps 22 which is designed to break at a predefined pressure. Destroyed rocket motor 3 parts in the inner chamber 7 can easily be cleaned by opening the vessel 2 through the front gable 16.

The RMDS is designed for firing rocket motors up to a weight of 100 kg propellant. The propellant can be single or double base propellant or a composite propellant containing ammonium per chlorate. The propellant can also contain other types of fuel such as hydrazine. Typical dimensions of rocket motor 3 to be destructed are, length=1500 mm and diameter=300 mm.

Depending on the rocket motor 3 type, up to four rocket motors 3 can be fired per hour. The RMDS can be operated in a one to three shift mode.

Alternative Embodiments

The invention is not limited to the examples shown, but may be modified in various ways without departing from the scope of the patent claims. The embodiment of the vessel arrangement can therefore be modified within the bounds of feasibility, provided that no additional components are added or fitted to vessel arrangement.

The invention claimed is:

1. A closed vessel arrangement (1) comprising a closed vessel (2) for safe destruction of rocket motors (3) containing solid propellant (4) by burning the rocket motor (3) inside the closed vessel (2), which closed vessel (2), is adjustable in size to rocket motors (3) of various sizes, characterized in that the closed vessel (2) comprises two chambers (7,8), one outer chamber (8) and one inner chamber (7) arranged coaxially to each other, which chambers (7,8) are divided into a plurality of connectable sections (13), which are connectable in various numbers for adjusting the size of the vessel (2) to rocket motors (3) of various sizes.

2. A closed vessel arrangement (1) according to claim 1, characterized in that the vessel (2) is partly filled with water (15) forming a water bath, for cooling the vessel (2) and for absorbing combustion gases and solid residues.

3. A closed vessel arrangement (1) according to claim 1, characterized in that the inner chamber (7) comprises a plurality of gas openings (14) for guiding flow of combustion gas and solid residues, from the inner chamber (7) to the outer chamber (8) via the water bath.

4. A closed vessel arrangement (1) according to claim 1, characterized in that the vessel (2) comprises at least one water inlet (9) for supplying fresh water (15) to the vessel (2), at least one water outlet (10) for emptying spent water (15) and solid residues from the vessel (2), at least one gas inlet (12) for supplying reaction gases and flushing air to the vessel (2) and at least one gas outlet (11) for emptying combustion gases from the vessel (2).

5. A closed vessel arrangement (1) according to claim 1, characterized in that the outer chamber (8) comprises two releasable gables (16,19), one front gable (16) and one rear gable (19), which releasable gables (16, 19) are coupled to the outer chamber (2) by bayonet couplings (6).

6. A closed vessel arrangement (1) according to claim 1, characterized in that the front gable (16) and the rear gable (19) are arranged slidably on rails (20) for easy handling.

7. A closed vessel arrangement (1) according to claim 1, characterized in that the chamber sections (13) are connected to each other by bolt connections (18).

8. A closed vessel arrangement (1) according to claim 1, characterized in that the rocket motor fixture (5) is arranged slidably in a through hole (17) in the front gable (16) between two positions, one inlet firing position, inside the vessel (2) and one outlet loading position, outside the vessel (2).

* * * * *